US005878864A

United States Patent [19]

Feldkämper

[11] Patent Number: 5,878,864

[45] Date of Patent: Mar. 9, 1999

[54] DEVICE FOR TURNING AND FEEDING BUNDLES

[75] Inventor: Richard Feldkämper, Lengerich, Germany

[73] Assignee: Windmöller & Hölscher, Lengerich/Westf., Germany

[21] Appl. No.: 842,567

[22] Filed: Apr. 15, 1997

[30] Foreign Application Priority Data

Apr. 15, 1996 [DE] Germany ..... 196 14 807.3

[51] Int. Cl.[6] ..... B65G 47/24

[52] U.S. Cl. ..... 198/409; 198/403

[58] Field of Search ..... 198/403, 409

[56] References Cited

U.S. PATENT DOCUMENTS

| | | | |
|---|---|---|---|
| 4,573,863 | 3/1986 | Picotte | 198/403 X |
| 4,618,054 | 10/1986 | Muller | 198/409 |
| 5,743,374 | 4/1998 | Monsees | 198/409 X |

FOREIGN PATENT DOCUMENTS

| | | |
|---|---|---|
| 0042198A1 | 12/1981 | European Pat. Off. . |
| 1 277 655 | 11/1971 | Germany . |
| 1 786 452 | 2/1972 | Germany . |

*Primary Examiner*—Joseph E. Valenza
*Assistant Examiner*—Gene O. Crawford
*Attorney, Agent, or Firm*—Evenson, McKeown, Edwards & Lenahan, PLLC

[57] ABSTRACT

The manufacture of bags requires stacks of tube sections to be separated as desired. The stacks must also be able to be turned 180° and then fed to a separating device so that filling valves can be attached to varying end areas. A suitable device for feeding and for turning and feeding bundles includes a support bracket which is seated in bearings in a frame so as to rotate or pivot. The support bracket is provided with a rotary or pivot drive. Guideways, running crosswise relative to the support bracket, are provided for rods which can be moved back and forth by a drive. The rods support a beam parallel to the support bracket which is connected perpendicularly to a number of mutually parallel arms. The device includes a crosswise support bracket which is connected to the support bracket by joining pieces. Tines are supported approximately parallel to the arms.

12 Claims, 7 Drawing Sheets

DEVICE FOR TURNING AND FEEDING BUNDLES

BACKGROUND OF THE INVENTION

1. Field of the Invention

This invention involves a device for turning and feeding bundles or stacks of flat workpieces so that further processing operations can be performed.

2. Description of Related Art

The manufacture of bags typically starts with the provision of flat-lying tube sections. Stacks of these tube sections, which were previously made in what is referred to as a tube drawing machine, must again be separated in order to be able to feed the separate tube sections, one after another and in proper position, to what is known as a floor feeder of a bag manufacturing system. Rotary feeders, into which successive stacks to be separated are loaded, are often used to separate bundles made of tube sections. A rotary feeder of this type is known from DE-PS 1,277,655, for example.

The tube section bundles or stacks to be separated must be loaded, turned or unturned, into the rotary feeder. The orientation of the bundles will depend on whether or not filling valves should be attached at the front or rear thereof. The particular attachment of the filling valves to the rear or front ends of the bags to be manufactured is important, for example, when the valves are to be fitted to imprints found on the bags.

It is known to manually place tube section bundles into the rotary feeder, in turned or unturned form, according to the side on which the filling valves are to be attached during bag manufacture.

SUMMARY OF THE INVENTION

One object of this invention is to create a device with which bundles, and preferably stacks made of flat workpieces, can be fed, in turned or unturned form, to a subsequent conveyor or subsequent processing devices.

This object is achieved, according to the invention, by providing a particular device for turning and feeding bundles or stacks of flat workpieces. A support bracket is seated in bearings in a frame so as to rotate or pivot. The device is provided with a rotary or pivot drive and guideways running crosswise for rods that can be moved back and forth by a drive. The rods support a beam, parallel to the support bracket, which is connected perpendicularly to a number of arms that are parallel to each other. The device also includes a crosswise support bracket which is connected to the support bracket by joining pieces and which supports tines oriented approximately parallel to the arms.

The bundles can be received from a supply conveyor or other such device and fed to a subsequent conveyor or to a subsequent processing device. In this way, the bundles in the device can be clamped on edge for the purpose of pivoting between the mutually parallel arms, on the one hand, and mutually parallel tines, on the other hand, which form surfaces that can be moved together. Packages can thus be received and fed to a subsequent conveyor or a subsequent processing device either unturned or after being turned on edge by approximately 135° or more.

The support bracket carrying the arms is seated in bearings in two opposing support bracket pieces which are guided in the same direction and mutually parallel in side parts of the side posts of the frame. In this way, a height compensation between the receiving station and the delivery station can be managed. Furthermore, height compensation must normally occur if the bundles to be fed are to be turned between the receiving station and the delivery station.

The support bracket forms the middle piece of a U-shaped frame having a side leg which is seated in bearings in the support pieces so that it can be swiveled around an axis parallel to the middle piece. A support piece can have a swivel drive for the frame.

In a further embodiment of the invention, the support bracket is provided with guideways running crosswise for guide rods which are essentially parallel to the tines and are connected, by a traverse parallel to the support bracket, to joining pieces of the crosswise support bracket carrying the tines. A drive is provided which moves the guide rods back and forth. Exactly positioned receipt and delivery of the bundles with a suitable control, especially before and after a horizontal swing, are made possible.

The drive can include toothed racks which are parallel to the guide rods and engaged by pinions which drive them.

In a further embodiment of the invention, the guideways for the rods carrying the beam by the arms and the guideways for the guide rods which carry the crosswise support by tines are arranged with corresponding drives in a slide carriage which can be moved on the support bracket. In this way, the bundles to be received can be received in a proper position and aligned in a proper position for delivery.

To move the slide carriage, a hydraulic piston-cylinder unit can be provided.

The rods which move the beam back and forth with the arms are the piston rods of the hydraulic piston-cylinder units.

Preferably, bearing pieces are guided on the outer arms so that they are lengthwise movable and fixable. In the bearing pieces, a shaft is seated in bearings such that it can be moved by a drive. The shaft supports stopper plates that clamp between the tines and can be swung until approximately in the plane of the arms.

Good alignment, delivery and receipt of the bundles are ensured when conveyor belts are arranged in the tines so that their conveyor carrying sides rise above the sides of tines facing the arms.

In order to be able to receive and deliver bundles both in unturned and in turned orientations, a supply conveyor is provided for the bundles such that the unit having the arms and tines is seated in bearings in the machine frame. The unit can be lifted, lowered and swung in such a way that the arms and the ends of the tines attached to the crosswise support can be moved under the discharge end of the supply conveyor.

BRIEF DESCRIPTION OF THE DRAWINGS

An embodiment of the invention is described more precisely in the following and is shown in the drawings.

DESCRIPTION OF THE PREFERRED EMBODIMENT

Figure 1:
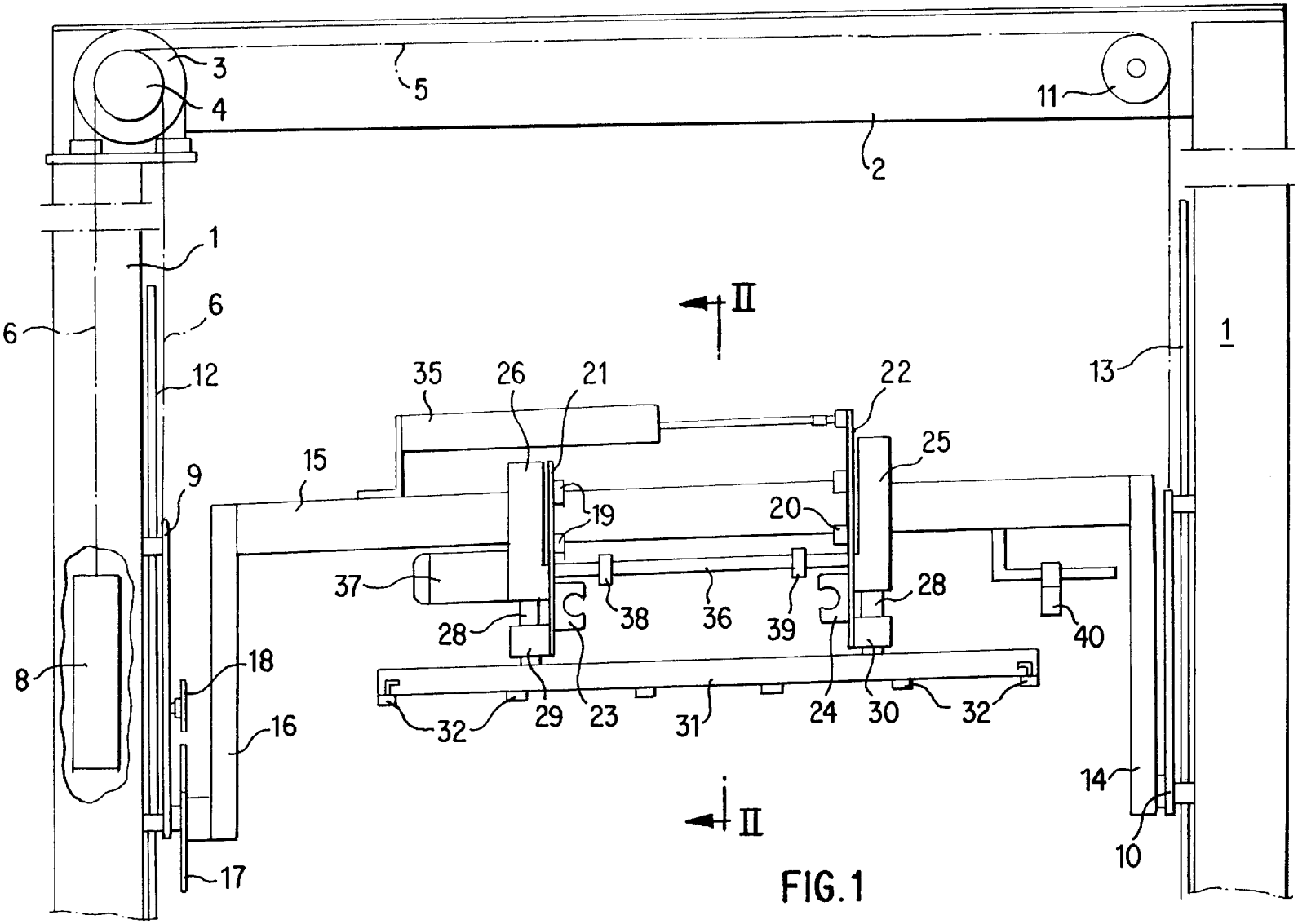
FIG. 1 is a front view of the device for removing bundles from a supply conveyor, or removing bundles from the supply conveyor and then turning the bundles, in which a structural assembly carrying tines is not shown for better viewing.

The device for receiving and feeding bundles in the received or turned position is located above a rotary feeder, for example, and includes two side posts 1 of a frame. The side posts are connected, at their upper ends, by a crosswise support 2. At the left end area of the crosswise support 2, a gear motor 3 is mounted. The gear motor 3 has a double sprocket 4 placed on its delivery shaft. Two chains 5 and 6 partially wrap around the double sprocket 4 and carry counterweights 7 and 8 on their strands running out to the left of the double sprocket 4. The other ends of the chains 5 and 6 are attached to slide carriage-type support pieces 9 and 10. The chain 5 is guided over a sprocket 11 seated so as to rotate in bearings in the right end area of the crosswise support 2. Both of the slide carriage-type support pieces 9 and 10 are seated in bearings so that they can be moved in guideways 12 and 13 which are connected to the side posts 1.

Figure 4:
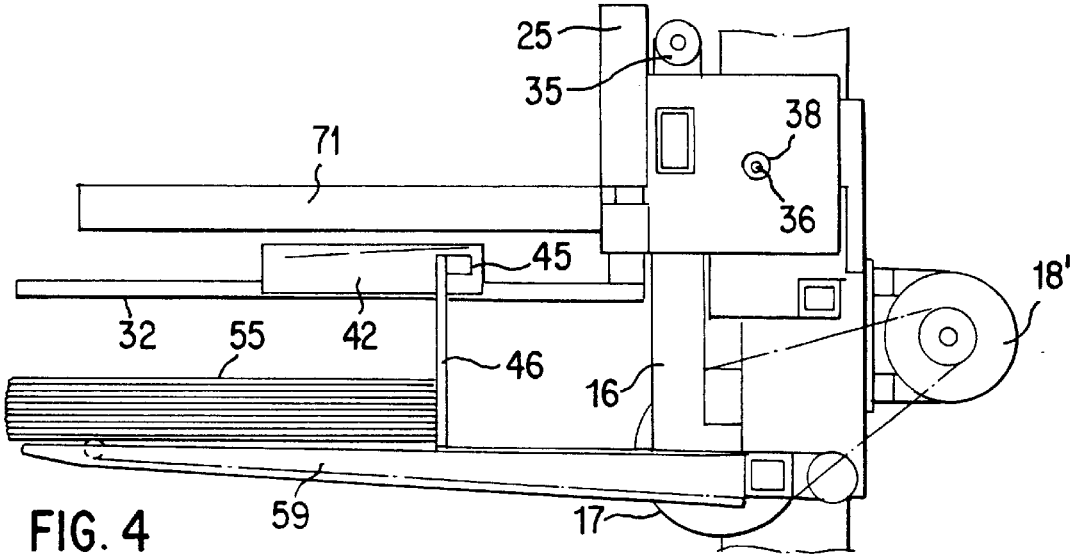
FIG. 4 is a sectional view of the device along line IV—IV in FIG. 3.
Figure 2:
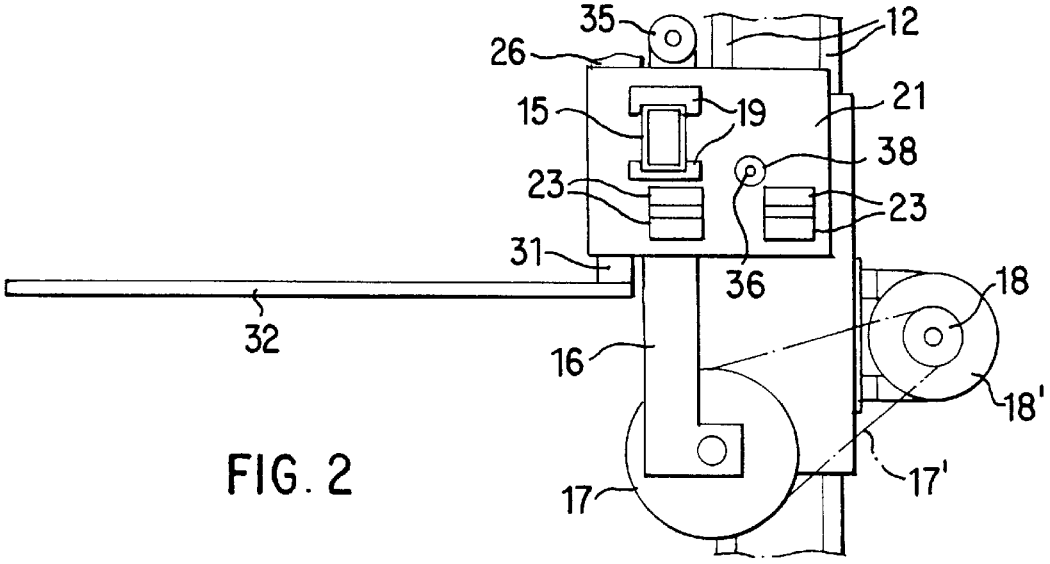
FIG. 2 is a sectional view of the device along line II—II in FIG. 1.

In the support pieces 9 and 10, the side legs 14 and 16 of a U-shaped frame are seated in bearings so as to rotate around bearing journals which are flush with each other. The side legs 14 and 16 are connected by a support bracket 15 to form the U-shaped frame. The right side leg 14 is seated in bearings directly mounted on a bearing journal. The journal stands perpendicularly on the right side leg 14 and is mounted in the support piece 10 in such a way that the leg 14 can be swung. The left side leg 16 is firmly attached, via a spacer, to a gear 17 which is seated in bearings in the support piece 9 so that it can be rotated. On the support piece 9, a gear motor 18', with a driven shaft which carries a pinion 18, is flange-mounted as shown in FIG. 2 and 4. The pinion 18 drives the gear 17 via a chain 17' so that the elements 14, 15 and 16 can be swung via the gear motor 18'.

The counterweights 7 and 8 ensure that the gear motor 3 can move the frame formed by the elements 14, 15 and 16, even vertically, without problems.

The support bracket 15 forms a horizontal channel web piece of the U-shaped frame. Plates 21 and 22 on the support bracket are separated by a defined distance. The plates can be moved via the guide shoes 19 and 20 which frame the support bracket 15. The guide shoes 19 and 20 are welded to the plates 21 and 22. The plates 21 and 22 are connected together by a traverse (not shown) to form a slide carriage which can be moved on the support bracket 15. To move the slide carriage formed by the traverse and the plates 21 and 22, a piston-cylinder unit 35, having a piston rod which is connected flexibly to the plate 22, is connected to an end area of the support piece 15 via a flange on the cylinder.

Cylinders 25 and 26 of piston-cylinder units are connected to the outer sides of the plates 21 and 22. The piston rods 28 of these units support a beam 31 at their ends. The beam 31 is parallel to the support bracket 15. Several arms 32, running out into the open, are attached at right angles on the beam 31 and are spaced apart from one another. The piston rods 28 are guided on guide bushings 29 and 30 attached to the plates 21 and 22 and to the beam 31.

On opposing inner sides of the plates 21 and 22 of the slide carriages, slideways or guideways 23 and 24 are attached crosswise to the support bracket 15. Guide rods 70 of a structural assembly which supports a tine 59 can be moved back and forth in the slideways as is described more precisely below. A shaft 36, driven by a gear motor 37, is seated in bearings in the plates 21 and 22 above the guideways 23 and 24. Two pinions 38 and 39 are fastened by wedges on the shaft 36 at a certain distance from one another and engage toothed racks 71 and 73 parallel to the guide rods 70. The manner in which this engagement occurs will be described more clearly below. The pinions 38 and 39 operate to move the structural assembly supporting tines 59.

Figure 5:
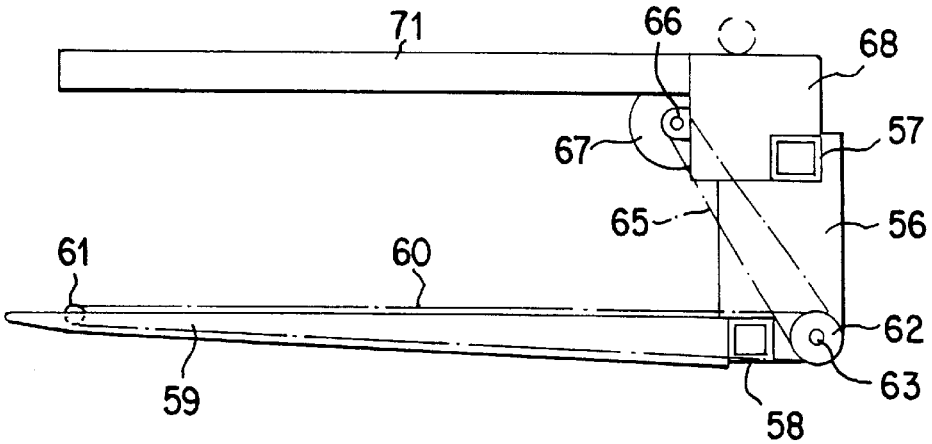
FIG. 5 is a side view of the structural assembly containing the tines.
Figure 3:
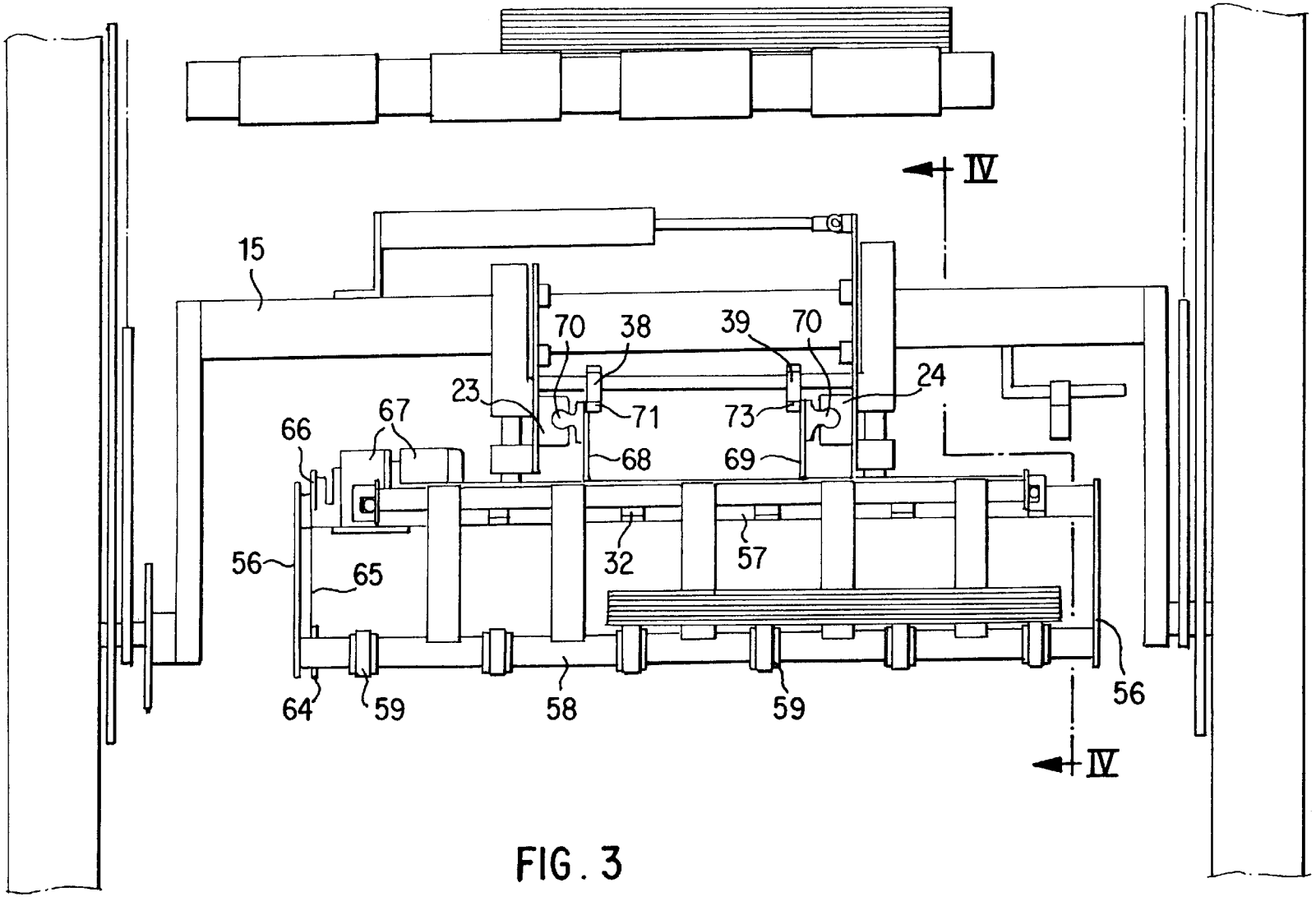
FIG. 3 is a front view of the device corresponding to FIG. 1 but showing the structural assembly carrying the tines.
Figure 6:
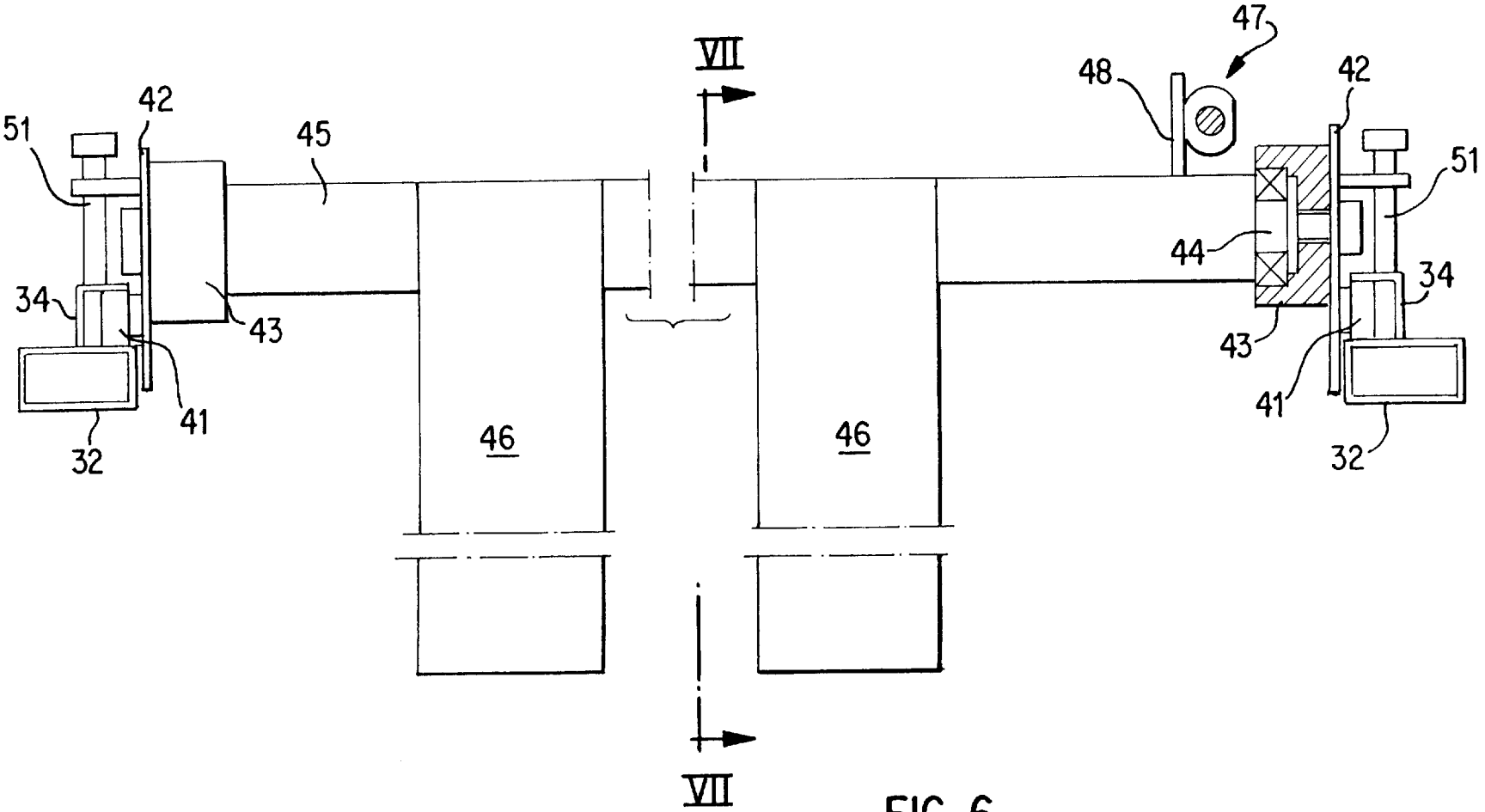
FIG. 6 is a front view, partially in section, of the shaft showing stopper plates which can be swiveled and attached on the side arms.
Figure 7:
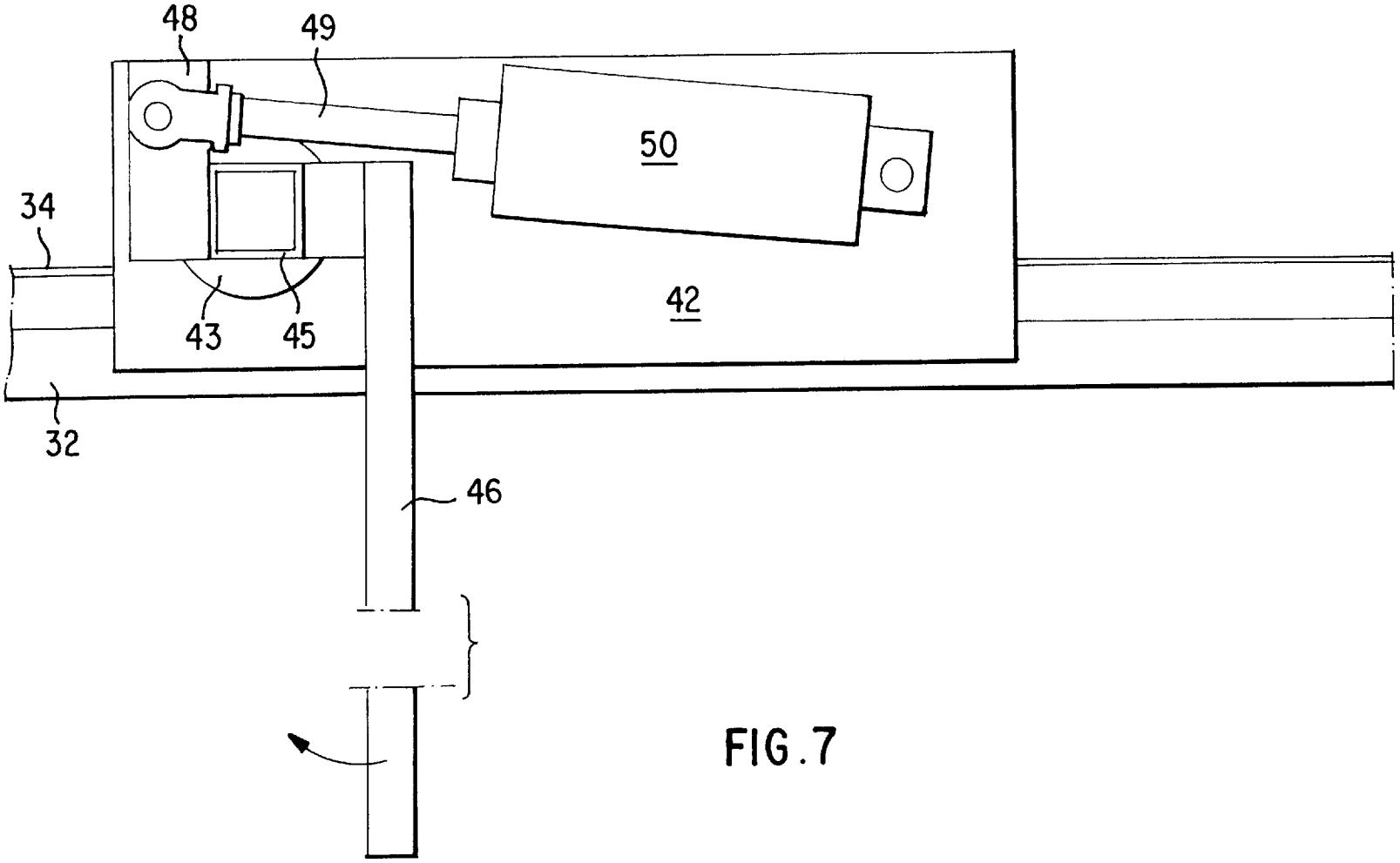
FIG. 7 is a sectional view of the device along line VII—VII in FIG. 6.

The structural assembly supporting the tines 59 will now be explained further with reference to FIGS. 3 and 5.

A crosswise support bracket 58, which is formed from a rectangular beam, supports tines 59 attached perpendicularly to the bracket at equal intervals. The crosswise support bracket 58 is connected into a rectangular frame by joining pieces 56 on opposite sides of the bracket. The pieces 56 are metal sheets and are also connected to a traverse 57 parallel to both the support bracket 58 and the support bracket 15. The traverse 57 also is formed from a rectangular beam. Two support plates 68 and 69 are welded to the traverse 57 in its center area. The plates 68 and 69 are spaced away from each other, extend up, and are connected at their outer sides to the guide rods 70 and on their upper sides to the toothed racks 71 and 73. The toothed racks 71 and 73 engage the pinions 38 and 39 in the manner shown in FIG. 3.

Each of the tines 59 is formed from a U-shaped beam with side legs which point in the direction of the guide rods 70. The guide rods 70 run roughly parallel to the tines 59. Conveyor belts 60 are arranged in the groove-shaped recesses of the tines 59 formed by the U-shaped beams. The carrying strand of each of these conveyor belts 60 rises above the side legs of the U-shaped beams. The conveyor belts 60 run over front deflection rollers 61, seated in bearings between the legs of the U-shaped beams, and over rear rollers 62. Each of the rollers 62 is set firmly on a shaft 63 which is seated rotatably in bearings in the plates 56. A sprocket 64 is seated on the shaft 63 and can be seen in FIG. 3. A chain 65 runs over the sprocket 64 and is driven by the sprocket 66 of a gear motor 67. The upper strand 60 of the conveyor belt 60 running in the groove-shaped recesses of the tines 59 is supported by intermediate rollers (not shown). The gear motor 67 is provided with a control by which the conveyor belt 60 can be reversibly driven via the drive mechanism.

Pivoting stopper plates or stopper arms 46 are connected to the external arms 32 in the manner shown in FIGS. 3, 4, 6 and 7. Angle beams 34, having upper legs which point toward each other, are welded to the outer arms 32 formed from rectangular beams. The angle beams 34 form, via upper sides of the arms 32, groove-shaped guideways for slide rods 41 which are firmly attached to the side plates 42. Bolted to the side plates 42 are pot-shaped bearings 43. The journals 44 of a shaft 45, formed from a rectangular beam, are seated, in ball bearings, in the pot-shaped bearings 43. Stopper arms 46, separated by an interval, are attached on the shaft 45 and extend perpendicular to the shaft 45. The shaft 45 is welded to a radial lever 48. The piston rod 49 of a piston-cylinder unit 47, having a cylinder 50 which is flexibly or pivotally connected to one of the side plates 42, is linked to the lever 48. By corresponding activation of the piston-cylinder unit 47, the stopper arms 46 can be swung between the tines 59 and approximately in the plane of the arms 32. This may be seen in FIG. 3.

The shaft 45 with the stopper arms 46 can be moved manually on the outer arms 32 into the desired position. In the desired position, the bearing 43 is then attached to the arms 32. The side plates 42 are provided with channel webs extending to the outside. A retention pin 51 is bolted in the channel webs and clamps on the upper legs of the angle beam 34.

A guide rod is attached on the support bracket 15. The guide rod extends parallel to the support bracket 15. A sensor 40 such as, for example, a photocell or a photosensor, can be moved along and selectively affixed to the guide rod. The sensor 40 can be used to record the respective edge position of the beam 31 and, thus, the position of the slide carriage including the cylinders 25 and 26.

Figure 8:
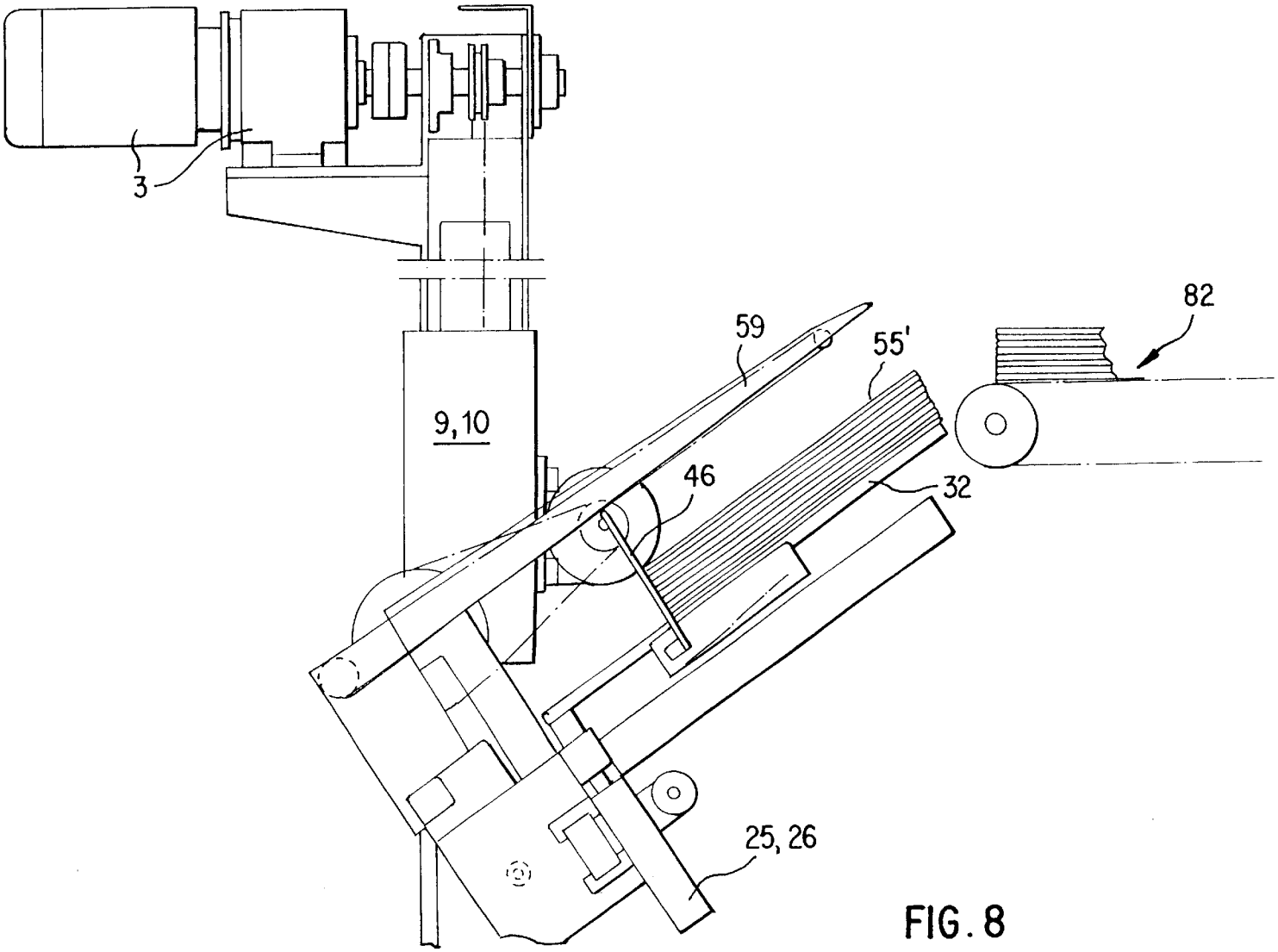
FIG. 8 is a side view of the device showing arms under the discharge end of the supply conveyor.
Figure 9:
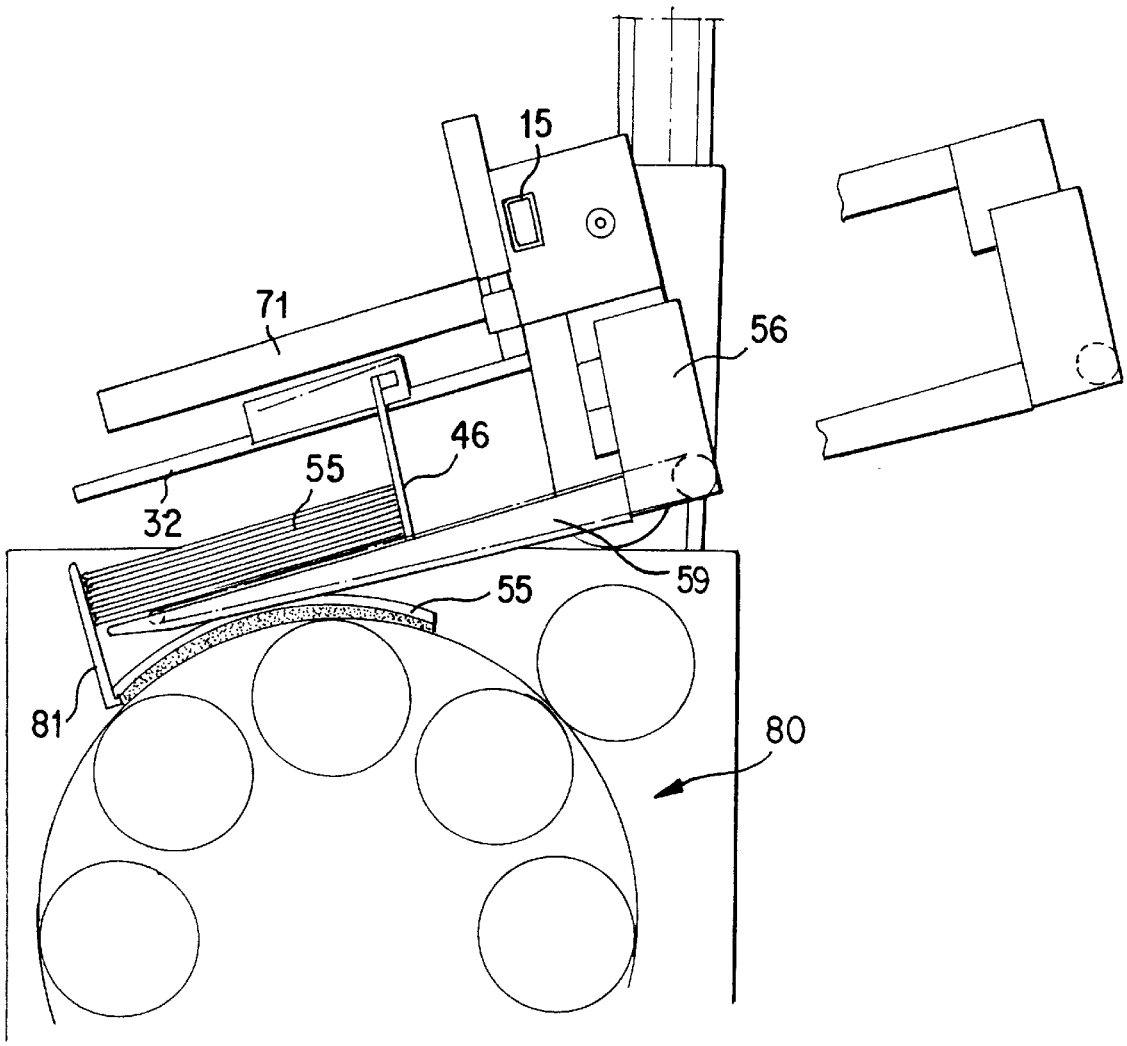
FIG. 9 is a representation of the device corresponding to FIG. 8 showing the structural assembly containing the tines as movable both under the discharge end of the supply conveyor and in the delivery position above a rotary feeder.

The function of the device for feeding bundles will now be described in connection with FIGS. 8 and 9. The bundles may optionally be turned before they are fed.

In the position shown in FIG. 8, the unit having arms 32 and tines 59 has been moved to the top of the guideways 12 and 13 of the side posts 1 and swung clockwise on end sufficiently far so that the shelf support formed by the arms 32 is located below the discharge end of the supply conveyor 82. In this position, the stopper arms 46 are driven out so that a tube section bundle 55' discharged by the supply conveyor 82 is deposited, when fed, on the arms 32 slanting against the stopper arms 46 in the manner shown. Then, the piston rods 28 of the cylinders 25 and 26 are driven out so that the arms 32 clamp the received tube section bundle 55' against the tines 59. The clamping and conveyor unit containing the arms 32 and tines 59 is then driven by the motors 3 and 18' and swung counterclockwise so that the tube section bundle 55 is transported in the manner shown in FIG. 9 into a position above the rotary feeder 80. In the position shown in FIG. 9, the clamp is opened by moving the arms 32 up. The tube section stack 55 lying on the stopper 81 of the rotary feeder 80 is then deposited on the rotary feeder and separated in the manner shown. In order to ensure a good deposit, the conveyor belts 60 arranged in the tines 59 are driven at a suitable speed while the tines are moved back so that the new tube section stack 55 is deposited in the proper position for the purpose of being separated on the rotary feeder 80.

If the tube section bundles to be deposited on and separated by the rotary feeder 80 are not to be turned after their removal from the supply conveyor 82, then the receiving rake formed by the tines 59 is swung by the gear motor 18 into a horizontal position and driven by the gear motor 3 to the height of the discharge end of the conveyor belt 82. The receiving rake is then driven backwards by a gear motor 37 and the pinions 38 and 39 until its rear end approximately contacts the conveyor belt 42. The stopper arms 46 are swung into the plane of the arms 56 so that a new tube section bundle 55 can be moved up from behind on the receiving rake formed from the tines 59. In order to prevent friction and to ensure a good delivery, the conveyor belts 60 running in the tines are activated until the tube section bundle delivered reaches the front ends of the tines 59 which run out into the open. The stopper arms 46 are then swung inside so that they clamp between the tines 59. The conveyor belts 60 are then driven in the opposite conveyor direction so that the tube section bundle lies against the stopper arms 46. Finally, the tines 59 are driven into the position shown in FIG. 9. The tube section bundle 55 is then placed on the rotary feeder in the manner described.

I claim:

1. A device for turning and feeding stacks made of flat workpieces comprising:

a movable support bracket which is connected to bearings in a frame so as to rotate or pivot, a rotary or pivot drive for driving said support bracket, guideways running crosswise to the support bracket, rods guided by the guideways and movable back and forth by a drive, a beam supported by the rods parallel to the support bracket, arms to which the beam is connected perpendicularly, the arms being parallel to each other, a crosswise support bracket connected to the movable support bracket by joining pieces, and tines supported by said crosswise support bracket approximately parallel to the arms.

2. A device according to claim 1, wherein the support bracket is seated in bearings in opposing support bracket pieces which are guided so as to move in the same direction and mutually parallel in side parts of the frame.

3. A device according to claim 2, wherein the movable support bracket forms a center piece of a U-shaped frame having a side leg connected to bearings in one of the support bracket pieces so that it can be swiveled around an axis.

4. A device according to claim 1, wherein a support piece has a swivel drive for the frame.

5. A device according to claim 1, wherein the guideways running crosswise are substantially parallel to the tines and connected, by a traverse parallel to the movable support bracket, to joining pieces of the crosswise support bracket carrying the tines, and further comprising a drive which moves the guide rods back and forth.

6. A device according to claim 5, wherein the drive includes toothed racks which are parallel to the rods and engage pinions which drive them.

7. A device according to claim 1, wherein guideways for the rods carrying the beam by the arms and guideways for guide rods which carry the crosswise support bracket by tines are arranged with corresponding drives in a slide carriage which can be moved on the support bracket.

8. A device according to claim 7, and further comprising a pressure-piston-cylinder unit for driving the slide carriage.

9. A device according to claim 8, wherein the rods which move the beam back and forth by the arms are the piston rods of pressure-piston-cylinder units.

10. A device according to claim 1, wherein bearing pieces are guided on outer arms so that they can be moved lengthwise and fixed, and in the bearing pieces, a shaft is seated in bearings such that it can be moved by a drive and supports stopper plates that clamp between the tines and can be swung approximately into the plane of the arms.

11. A device according to claim 1, and further comprising conveyor belts having upper strand sides which rise above sides of the tines which face the arms arranged in the tines.

12. A device according to claim 1, and further comprising a supply conveyor provided for the bundles and wherein the unit having the arms and tines is seated in bearings in the machine frame so that it can be lifted and lowered and swung in such a way that, on one hand, the arms and, on the other hand, the ends of the tines attached to the crosswise support can be moved under a discharge end of the supply conveyor.

* * * * *